US007938255B2

(12) United States Patent
Newman

(10) Patent No.: US 7,938,255 B2
(45) Date of Patent: May 10, 2011

(54) INTERNAL MEMBER FOR DISPOSABLE SOFT CONTACT LENS PACKAGING

(75) Inventor: Stephen D. Newman, Bayshore Park (SG)

(73) Assignee: Menicon Singapore Pte Ltd., Singapore (SG)

( * ) Notice: Subject to any disclaimer, the term of this patent is extended or adjusted under 35 U.S.C. 154(b) by 102 days.

(21) Appl. No.: 11/931,955

(22) Filed: Oct. 31, 2007

(65) Prior Publication Data

US 2008/0078681 A1 Apr. 3, 2008

Related U.S. Application Data

(60) Continuation-in-part of application No. 11/404,200, filed on Apr. 13, 2006, now Pat. No. 7,828,137, which is a division of application No. 10/789,961, filed on Feb. 27, 2004, now Pat. No. 7,086,526, which is a continuation-in-part of application No. 10/781,321, filed on Feb. 17, 2004, now abandoned, which is a continuation-in-part of application No. PCT/AU02/01105, filed on Aug. 17, 2002.

(51) Int. Cl.
*A45C 11/04* (2006.01)

(52) U.S. Cl. ..... 206/5.1

(58) Field of Classification Search ..... 206/5.1, 206/210; 15/104.92, 104.93, 214, 244.1; 134/901
See application file for complete search history.

(56) References Cited

U.S. PATENT DOCUMENTS

| | | | | |
|---|---|---|---|---|
| 3,977,517 | A * | 8/1976 | Kadlecik et al. | 206/5.1 |
| 5,439,572 | A * | 8/1995 | Pankow | 204/450 |
| 5,657,506 | A * | 8/1997 | Pankow | 15/104.92 |
| 6,134,736 | A * | 10/2000 | Pankow | 15/104.92 |
| 6,138,312 | A * | 10/2000 | Cummings | 15/104.92 |
| 6,364,098 | B2 * | 4/2002 | Yavitz | 206/5.1 |
| 2001/0017271 | A1 * | 8/2001 | Yavitz | 206/5.1 |
| 2006/0054514 | A1 | 3/2006 | Tokarski et al. | |
| 2006/0213783 | A1 | 9/2006 | Tokarski et al. | |
| 2007/0056861 | A1 | 3/2007 | Duis et al. | |
| 2007/0089998 | A1 | 4/2007 | Tokarski et al. | |
| 2007/0199832 | A1 | 8/2007 | Newman | |

FOREIGN PATENT DOCUMENTS

| | | | |
|---|---|---|---|
| WO | 2006102384 | A | 9/2006 |
| WO | 2007047594 | A | 4/2007 |
| WO | 2008044145 | A | 4/2008 |

* cited by examiner

*Primary Examiner* — Luan K Bui
(74) *Attorney, Agent, or Firm* — Holland & Hart LLP

(57) ABSTRACT

A contact lens package includes a container, a contact lens, and an internal member configured facilitate a restoration of the contact lens to a desired shape when the package is opened by the user.

14 Claims, 13 Drawing Sheets

INTERNAL MEMBER FOR DISPOSABLE SOFT CONTACT LENS PACKAGING

RELATED APPLICATIONS

This application is a continuation-in-part of U.S. patent application Ser. No. 11/404,200 filed Apr. 13, 2006 titled "Packaging for Disposable Soft Contact Lens", U.S. Pat. No. 7,828,137, which is a divisional application of U.S. patent application Ser. No. 10/789,961, filed on Feb. 27, 2004, U.S. Pat. No. 7,086,526, which is a continuation-in-part of U.S. patent application Ser. No. 10/781,321, filed Feb. 17, 2004, now abandoned, which is a continuation-in-part of PCT Patent Application No. PCT/AU02/01105, filed Aug. 17, 2002, designating the United States, both of which are hereby incorporated by reference in their entirety.

BACKGROUND

Soft disposable contact lenses are commonly contained in disposable packages. As packaging adds to the overall cost of the lens, it should be made as economically as possible but without compromise to the requisite packaging criteria.

The traditional blister pack packaging (shown in FIGS. 1-3) for disposable lenses (both bi-weekly and daily) consists of a polypropylene receptacle for the lens (herein after referred to as a "boat"), topped by a multi-layer film consisting of polyethylene, aluminum, a bonding agent and polypropylene. The boat is typically an injection molded plastic which has high stiffness but is capable of limited elastic deflection and includes a preformed recess. The boat is filled with a suitable storage solution, preferably saline, and receives a single lens in situ. The blister pack is sealed, then autoclaved using steam and pressure to terminal sterility. These blister packs are presented to the patient in boxes of individual packs (FIGS. 4-5) or as multiple blister strips.

The marketing objective is to present the contact lens to a patient in an aesthetically pleasing package that both satisfies the statutory requirements for sterility and stability, and allows the patient to remove the lens safely and easily. The packaging is used only once and is discarded after the lens is removed. This impacts the costs of the lens/package combination. In order to reduce the overall price of the lens to the patient, the cost of the packaging should be kept to an absolute minimum. In addition, disposability of lens packages necessitates conformity with ecological standards.

The lens must be kept hydrated while in the package. The package must be well sealed and should minimize water vapor transmission through the boat and laminated layer to maximize the shelf life and prevent dehydration of the lens contained therein. In use, the user removes the laminated material from a flange formed on the boat by peeling back the cover to expose the lens immersed in a hydrating solution.

There is a long felt need in the disposable contact lens industry to provide an economic, space-efficient, and convenient, disposable contact lens package without compromise to durability, sterility, and utility of the lens.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
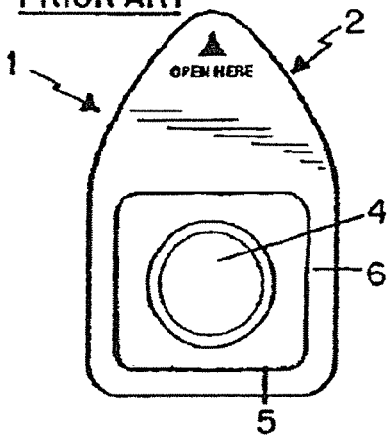
FIG. 1 PRIOR ART
FIG. 1 is a plan view of a typical prior art disposable blister contact lens package.

The present specification provides an economical package without compromise to statutory and medical requirements of contact lens packages.

The single-use package, in the embodiments described below, offers a number of advantages over the prior art blister pack concept. First, the single-use package is smaller and slimmer which lends itself to disposability and is ideal for traveling. Additionally, the number of packages in a secondary container may be increased, yet storage space for that secondary package may be reduced.

Further, the present exemplary economical package may be designed to incorporate any number of materials, colors, and/or surface finishes while still conforming to statutory and medical requirements.

The exemplary single-use package may be composed of foil sheets attached to either side of a substrate which stabilize light exposure and prevent oxygen transmission. Further, in some embodiments there is no air in the package, thus non-ballasted autoclaving is not required. The absence of air in the package contributes to lens stability in the package. Thus, the shelf-life of a contact lens in a single-use package may be extended. Overall, the exemplary single-use package is a more convenient and cost effective form of packaging.

Conventional contact lens packages are typically stiff and preformed with a profiled recess to house the lens therein. The preformed recess in the known packages is intended to ensure that the lens shape is maintained and is not deformed by the package. According to one exemplary embodiment, a contact lens package disclosed herein does not maintain the lens in an equilibrated position, but instead holds the lens in a flattened or compressed state. In this embodiment, the package has an internal depth which is less than an overall sagittal depth of the contact lens when the contact lens is in its equilibrated form. A contact lens can be compressed or otherwise confined in the package such that the lens is always maintained in a consistent orientation inside the contact lens orifice. According to one exemplary embodiment, the lens is maintained with its front surface oriented toward the top sealing material.

To aid in the restoration of the contact lens to its uncompressed profile, an internal member may be inserted under the contact lens such that when the package is open, the internal member exerts restoring force on the contact lens. Further the internal member can aid in the user locating and picking up the contact lens. In many packaging configurations, the contact lens adheres to the packaging due to hydrophobic interactions, surface tension, or other forces. This makes removal of the lens by the user difficult. As the user attempts to remove the lens from the packaging, the lens can be lost, damaged, or contaminated. Including an internal member that prevents the lens adhering to its surroundings and presents the lens in a consistent orientation can greatly ease the removal of the contact lens by the user. Various geometries of internal members contained in contact lens packages are disclosed in copending application (reference 40361-0067) which is hereby incorporated in their entirety.

Another embodiment is a single-use package with a contact lens therein. The package comprises two sheets of material sealed on each side of a substrate defining an orifice, a restoring member in the form of a foam disc is disposed between the sheets in the orifice, and an amount of hydration medium, wherein the lens in maintained in a flattened state while the package is sealed. A package for contact lenses and a method for manufacturing the contact lens packaging are described herein. More specifically, a package with a substrate having a sheet on both the top and bottom surfaces is disclosed herein. According to one exemplary embodiment, the package is smaller than traditional packages. Further, a method for manufacturing the above-mentioned package is disclosed as well as a method for providing a seal that is both easy to open and more secure to environmental breach when compared to traditional seals.

As used in the present specification and in the appended claims, the term "contactable material" refers generally to any material which may come into physical and fluid contact with a contact lens. A contactable material should be free of potentially toxic or irritant extractable or leachable materials, particularly if subject to forcing conditions such are experienced during steam sterilization at 121° C. Although polypropylene is commonly used as a contactable material in contact lens packages, any other material that is capable of maintaining a sterile environment for contact lenses can be used in the present article and method as well. According to one exemplary embodiment, a contactable material may include any material accepted by the Food and Drug Administration (FDA) as suitable for the packaging of sterile medical devices, or in direct food contacting applications.

Additionally, as used in the present specification and the appended claims, the term "sagittal depth" and "sagittal depth in a relaxed state" when referring to a contact lens shall be interpreted as the height of a contact lens in an equilibrated state. In other words, the saggital depth of a contact lens shall be interpreted as a designed saggital depth of a contact lens in an equilibrated state.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 2:
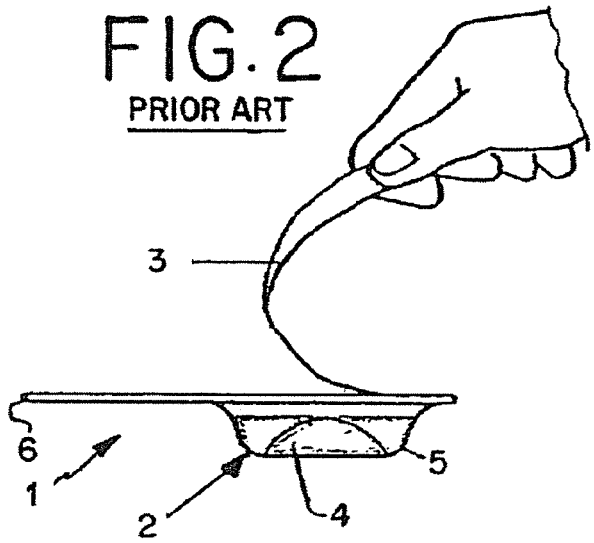
FIG. 2 PRIOR ART
FIG. 2 is a side view of the package of FIG. 1 with the lid peeled away to release the contact lens therein.
Figure 3:
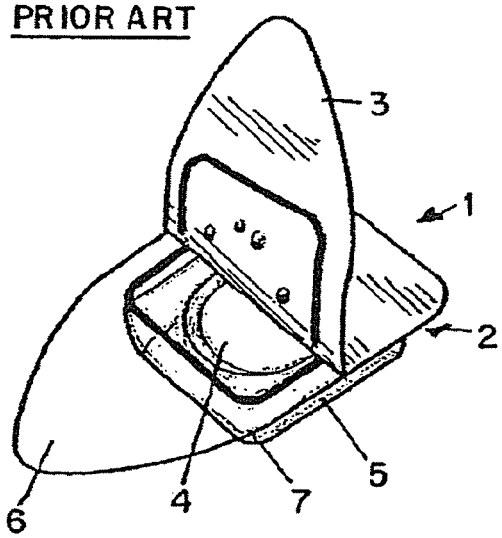
FIG. 3 PRIOR ART
FIG. 3 is a perspective view of the partially opened package of FIG. 2.

Referring to FIGS. 1 and 2, there is shown a typical prior art disposable blister contact lens package (1) which is formed in two parts. The package (1) comprises a blister pack member (2) which is sealed by a membrane (3) forming a lid on the package (1) and which may be peeled away to release a contact lens (4) therein. In FIG. 3, the package of FIG. 2 is shown with the membrane (3) peeled away to expose the contact lens (4). Typically, the member (2) will be a preformed blister pack and include a profiled recess (5) which provides a recess in which a lens may be placed. The member (2) is typically injection molded and the package is completed with a sealing membrane (3) which mates with a flange (6) to create a hermetic seal capable of maintaining sterility within the package after terminal sterilization. The contact lens (4) is immersed in a solution (7) which keeps the lens hydrated until it is removed from the pack. The injection molded member (2) makes this an expensive package to manufacture, with the result that the contact lens will inevitably be more expensive for the consumer.

Figure 5:
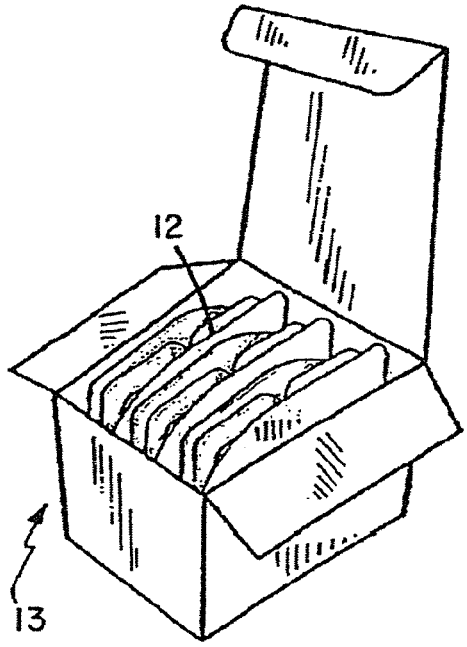
FIG. 5 PRIOR ART
FIG. 5 is a perspective view showing a plurality of blister packs stacked as in FIG. 4 and contained in a carton.
Figure 4:
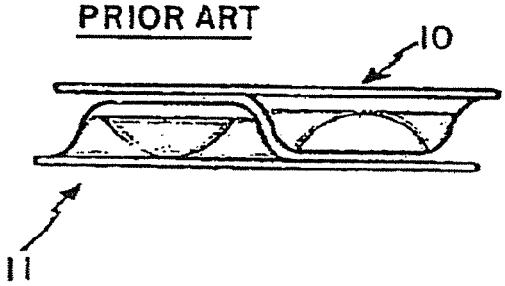
FIG. 4 PRIOR ART
FIG. 4 is a side elevation view showing a stacking arrangement for two identical prior art contact lens packages according to one embodiment.

FIG. 4 shows a stacking arrangement for two identical prior art contact lens packages (10 and 11). It can be seen from FIG. 4 that although two packs conveniently inter-fit, they take up a thickness greater than the thickness of one contact lens package. Ideally, a lens package should take up as little space as possible considering the relatively small size of a contact lens. Economy of storage space is a critical issue where lenses are mass produced. The existing blister packs take up a disproportionate amount of space relative to the size of the lens, leading to increased handling and storage costs. FIG. 5 shows a plurality of like blister packs (12) stacked as in FIG. 4 and retained in a carton (13). This bulky, inconvenient, and materials-intensive form of lens packaging exists as a result of conventional wisdom which suggests that lenses can only be stacked in rigid containers which isolate the lens from external load.

Exemplary Articles

Figure 6:
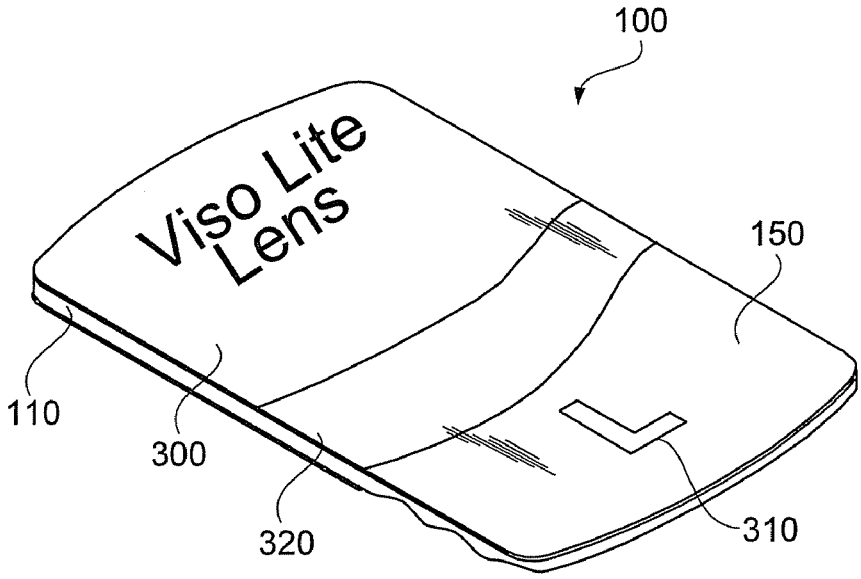
FIG. 6 is a top perspective view of a contact lens package, according to one exemplary embodiment.

FIG. 6 is a top perspective view of a contact lens package, according to one exemplary embodiment. As illustrated in FIG. 6, the present exemplary contact lens package (100) includes a center substrate (110) including a top sheet member (150) coupled to the top surface of the substrate. According to one exemplary embodiment, the top sheet member (150) is coupled to the top surface of the substrate (110) by a secure but detachable connection such that the top sheet member (150) can be separated from the substrate (110) with a constant and relatively low pulling force. Additionally, as will be described in further detail below, the top sheet member (150) is coupled to the top surface of the substrate (110) sufficient to allow the exemplary contact lens package (100) to be autoclaved. Further, FIG. 6 shows that the top sheet member (150) may contain various words and/or images including, but in no way limited to a brand name (300), a design (320), and/or information about the contact (310), for example, that it is for the left or right eye, and instructions for use.

Figure 7:
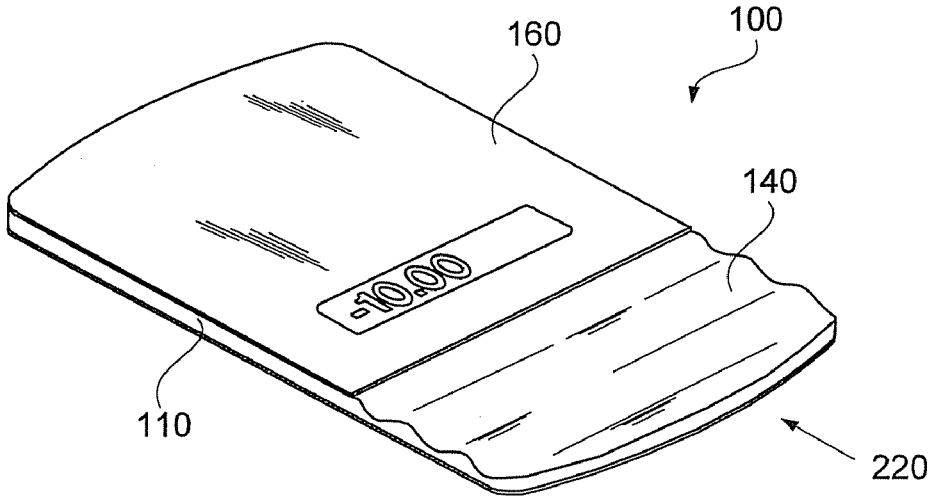
FIG. 7 is a bottom perspective view of a contact lens package, according to one exemplary embodiment.

Similarly, FIG. 7 is a bottom perspective view of the present exemplary contact lens package (100), according to one exemplary embodiment. As illustrated, a bottom sheet member (160) is coupled to the bottom surface of the substrate (110), opposite the top sheet member (150). As shown, the bottom sheet member (160) may be permanently or quite securely coupled to the bottom surface of the substrate (110) without a non-coupled portion or other member for removal of the bottom sheet member (160) from the substrate. FIG. 7 also illustrates a handle end (220) contains a gripping surface (140) on the bottom surface of the substrate (110).

According to one exemplary embodiment, the exemplary top sheet (150) and the exemplary bottom sheet (160) may include a foil. This foil may include, but is in no way limited to, a bottom or innermost layer comprising a homogeneous contactable material such as polypropylene. Above the inner layer may be, according to one exemplary embodiment, a layer of metal foil such as aluminum that provides strength and flexibility. Above the aluminum layer, a top layer may be formed including a polymer, such as polyethylene.

The exemplary bottom sheet (160) may also include a foil according to one exemplary embodiment. As mentioned above, the top or innermost layer of the bottom sheet (160) which is in physical or fluid contact with the lens includes a contactable material. The bottom sheet (160) is otherwise designed to maintain the integrity of the packaging during handling, and may comprise the same layers as the top sheet (150), as mentioned above. The bottom sheet (160) does not need to be opened and thus may be permanently attached to the substrate (110), such as through a high temperature heat seal or other substantially permanent coupling. In an exemplary embodiment, the foil is shorter in length than the substrate so that the bottom sheet covers and is attached to body end of the substrate, but not to the handle portion. Words and images may also be printed on the bottom foil.

Figure 8:
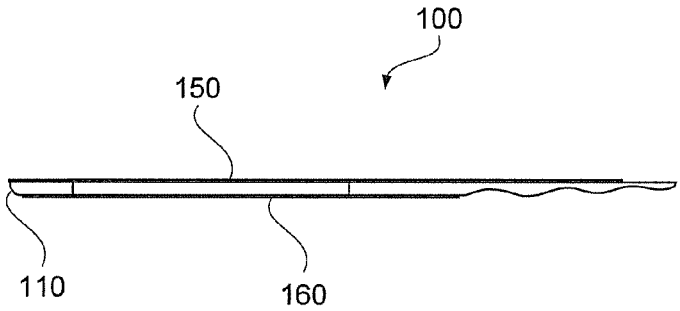
FIG. 8 is a side view of a contact lens package including a center substrate and a foil layer on a top and bottom surface of the substrate, according to one exemplary embodiment.

FIG. 8 illustrates a side view of the present exemplary contact lens package (100), according to one exemplary embodiment. As shown, a majority of the height of the present contact lens package (100) is made up of the substrate (110). FIG. 8 also illustrates the top sheet member (150) and the bottom sheet member (160) coupled on opposing sides of the substrate (110). In some embodiments, the sagittal depth of the lens (200) in a relaxed state is larger than the internal depth of the substrate defined by the center orifice (180). According to this exemplary embodiment, the lens (200) is compressed to fit inside the package (100). This allows for a lighter and more compact package (100). However, the present exemplary contact lens package (100) is in no way limited to a package in which the contact lens (200) is compressed therein. Rather, the present exemplary teachings and methods may be incorporated in a contact lens package (100) having an internal cavity, defined by the center orifice (180), that is larger than the sagittal depth of the contact lens (200).

Figure 9:
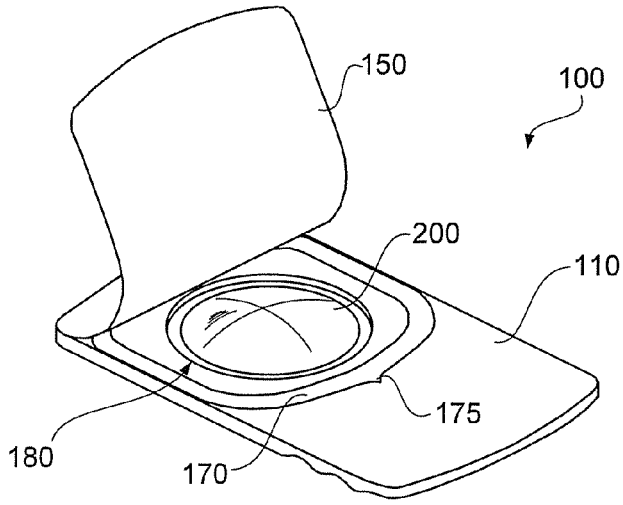
FIG. 9 is a top perspective view of a partially opened contact lens package, according to one exemplary embodiment.

FIG. 9 illustrates a top perspective view of a partially opened contact lens package, according to one exemplary embodiment. As shown in FIG. 9, the exemplary substrate (110) includes an orifice (180) defined therein. According to one exemplary embodiment, the contact lens (200) is disposed in the orifice (180) either alone or with a re-shaping member (not shown) such as a spring disc or a foam shape restoration member. FIG. 9 also illustrates a seal mark (170) indicating where the top foil (150) was adhered to the top surface of the exemplary substrate (110). As shown in FIG. 9, the seal mark (170) may include a peak (175) or a point used to initiate removal of the top sheet member (150) from the substrate (110). According to one exemplary embodiment, the incorporation of the peak (175) allows the initial force imparted on the foil to be applied to a relatively small area of bonded material, thereby allowing for easy initiation of the separation of the top sheet member (150) from the substrate (110). According to one exemplary embodiment, a relatively large portion of the top sheet member (150) may be bonded to the substrate (110) thereby increasing barrier between the atmosphere and the contact lens (200). Consequently, the present exemplary contact lens packaging system (100) reduces the risk that a loss of sterility of the contact lens will occur.

Figure 10:
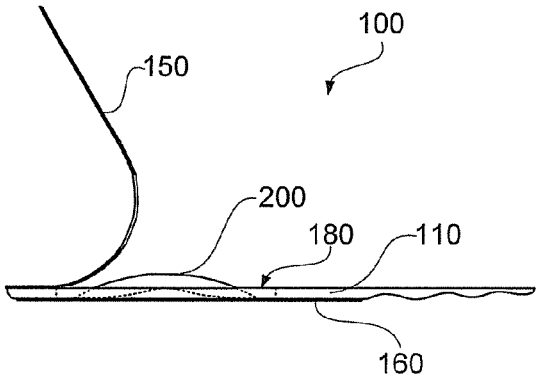
FIG. 10 is a side view of a partially opened contact lens package, according to one exemplary embodiment.

FIG. 10 further illustrates the effect of removing the top sheet member (150) from the substrate (110), according to one exemplary embodiment. As mentioned, the contact lens (200) may be compressed when positioned in the orifice (180) portion of the substrate (110) and the top sheet member (150) and the bottom sheet member (160) are sealed to the substrate. Once the top sheet member (150) is removed, the contact lens (200) may return to its natural sagittal depth. As illustrated in FIG. 10, the lens (200) may return to its natural curved shape without outside motivation. Alternatively, a internal member such as a spring disc (not shown) or foam member may be placed within the orifice (180) to aid the lens in returning to its natural shape.

Figure 11:
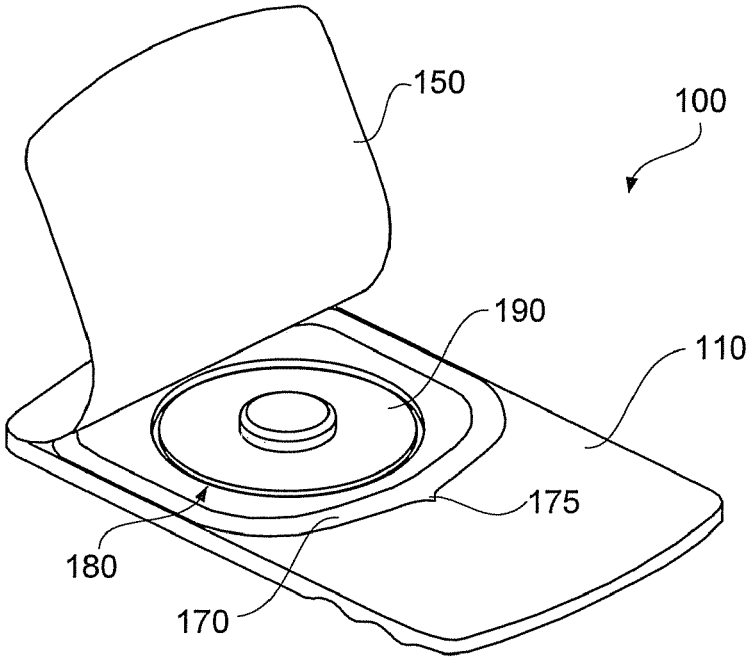
FIG. 11 is a top perspective view of a partially opened contact lens package containing a foam shape restoration member, according to one exemplary embodiment.

FIG. 11 illustrates an exemplary contact lens packaging system (100) including a foam restoration member (190) disposed in the orifice (180). For clarity of illustration, the contact lens (200, FIG. 10) that rests on top of the foam restoration member (190) has been removed. According to one exemplary embodiment, the foam restoration member (190) may be positioned in the orifice (180) as an integrated portion of the substrate (110) or adhered to the substrate (110) or the bottom film (160). Alternatively, the foam restoration member (190) may be an independent member disposed in the orifice (180) without coupling structure, thereby allowing the foam restoration member (190) to float within the orifice.

Figure 12:
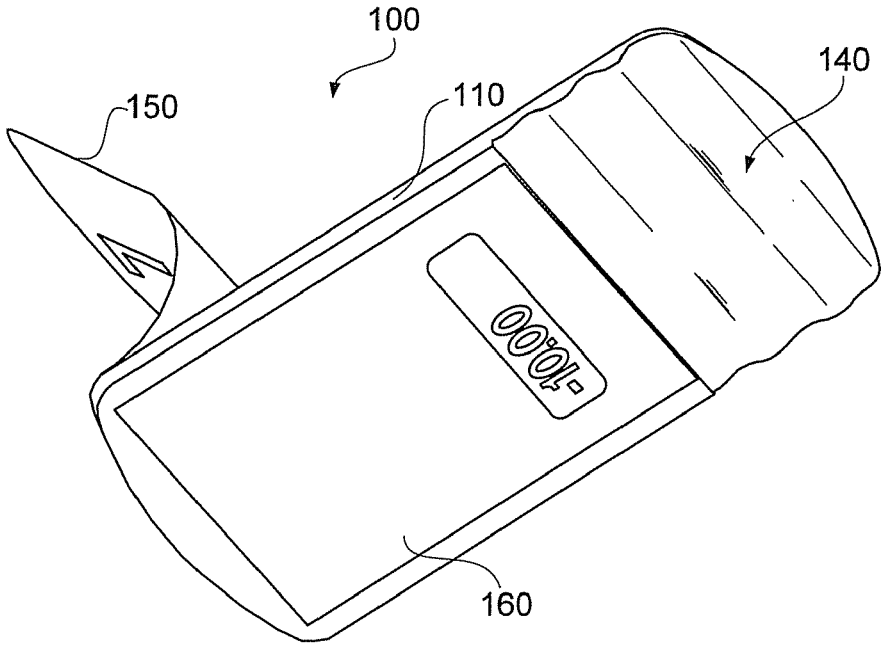
FIG. 12 is a bottom perspective view of a partially opened contact lens package, according to one exemplary embodiment.

As shown by the bottom perspective view of FIG. 12, the bottom sheet member (160) is not removed during removal of a contact lens (200, FIG. 10) from the present contact lens packaging system. Rather, according to one exemplary embodiment, the bottom sheet member (160) is securely adhered to the bottom surface of the substrate (110) without access tabs or any other material that allows for the removal of the sheet member. Also illustrated in FIG. 12, the ridged grip area (140) aids in the removal of the top sheet member (150).

Figure 13:
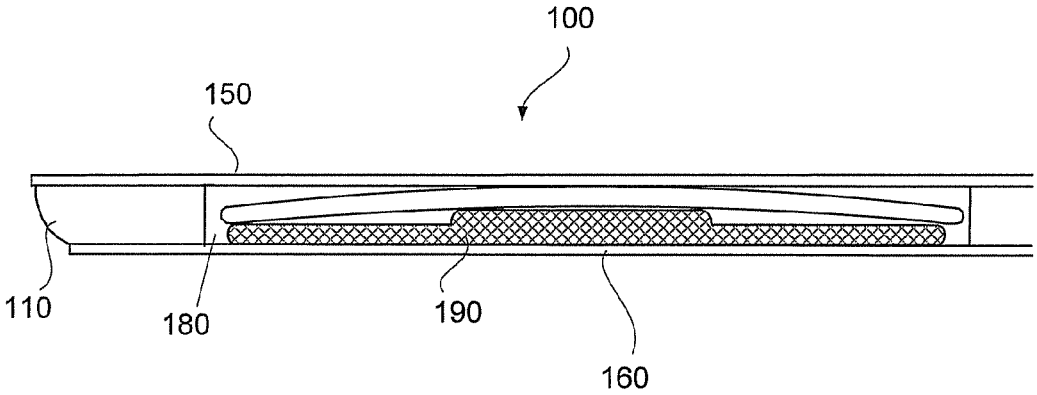
FIG. 13 is a cross-sectional side view of a contact lens package, according to one exemplary embodiment.

FIG. 13 is a side cutaway view of a contact lens package, according to one exemplary embodiment. As illustrated in FIG. 13, the substrate (110) defines an orifice (180) configured to receive the contact lens (200) and other packing elements. In this exemplary embodiment, a foam restoration member (190) is present in its compressed configuration below the lens (200). In one embodiment the contact lens package (100), in its closed configuration (FIG. 13), the balance of the internal volume as defined by the orifice (180), the top sheet (150) and bottom sheet (160) is substantially filled with solution.

Figure 14:
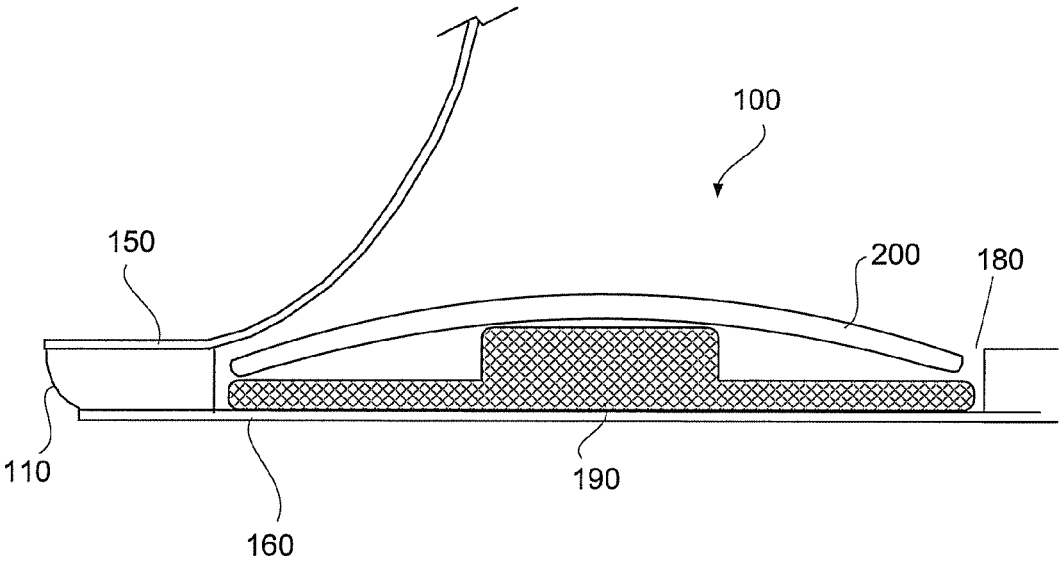
FIG. 14 is a cross-sectional side view of a partially opened contact lens package, according to one exemplary embodiment.

FIG. 14 is a side cutaway view of a partially opened contact lens package (100), according to one exemplary embodiment. As illustrated in FIG. 14, the top film layer (150) has been pulled back to expose the orifice (180) and its contents. When the containment of the top film layer (150) is removed, the foam restoration member expands, facilitating the contact lens (200) in regaining its relaxed form. During its expansion, the foam restoration member (190) can also absorb the hydrating solution to prevent it from spilling onto the surroundings. Additionally, the foam restoration member (190) can be configured to lift the contact lens slightly above the orifice (180) which facilitates the grasping of the contact lens by the user. The foam restoration member additionally maintains the orientation of the lens during the packing, shipping, and opening processes such that the contact lens is presented to the user in a consistent orientation and location. This could be particularly helpful for users because, as they are manipulating the packaging to insert the contact lens, they have less than perfect visual acuity.

According to one exemplary embodiment, the foam restoration member may be fixed to the substrate (110) or to the bottom film (160) to prevent the foam from being accidentally lifted out of the orifice by the user. In another embodiment the foam restoration member (190) is free floating within the orifice (180).

Figure 15:
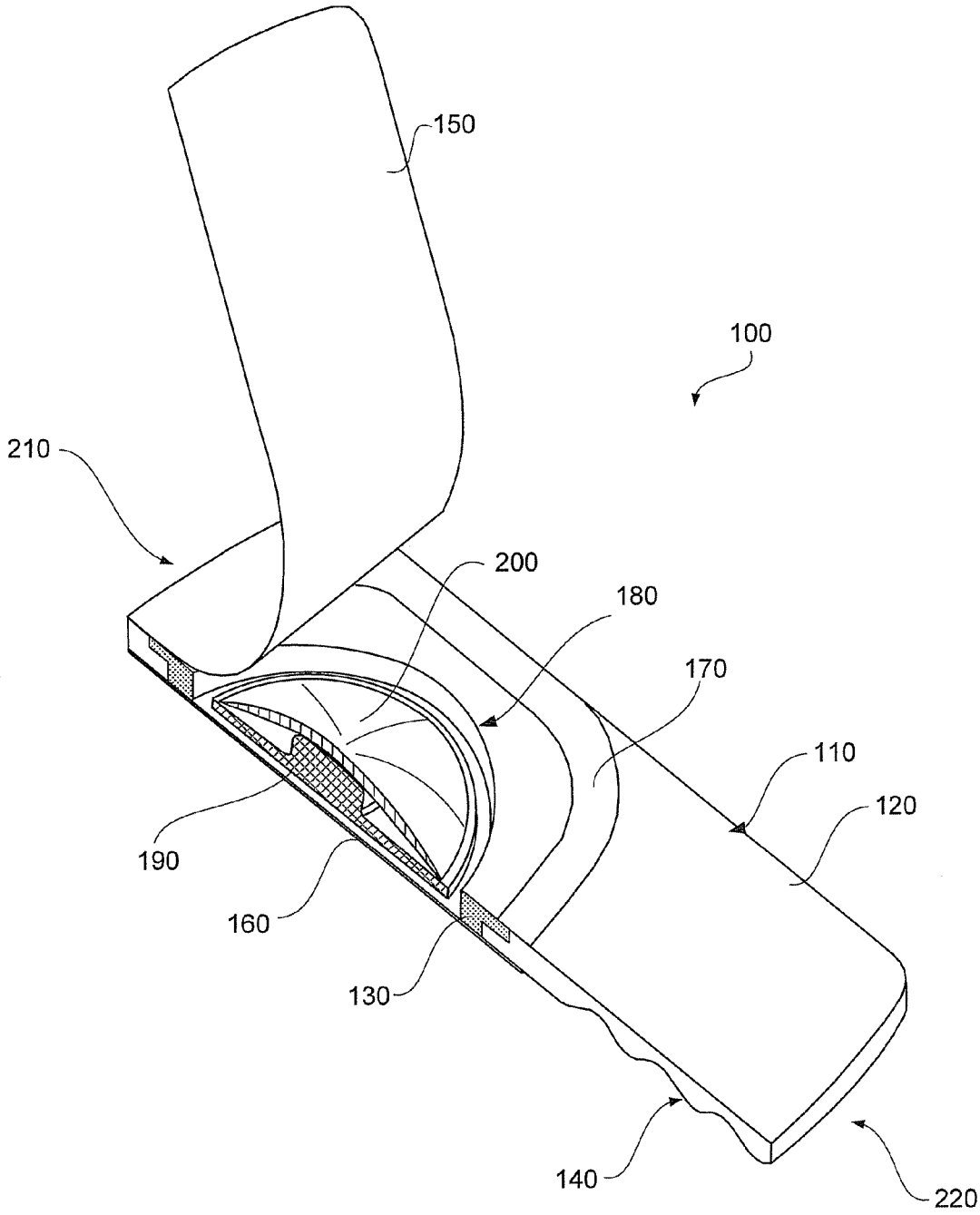
FIG. 15 is a cross-sectional perspective view of a partially opened contact lens package, according to one exemplary embodiment.

FIG. 15 shows a cutaway perspective view of a partially opened contact lens package, according to one exemplary embodiment. As illustrated in FIG. 15, the substrate (110) may be formed from a plurality of materials including a contacting region (130) that may be exposed to the lens (200). This contacting region (130) may include, according to one exemplary embodiment, a homogeneous material such as natural or homopolymer polypropylene to ensure the lens is not exposed to potentially irritating or toxic leachables. Alternatively, the contacting region (130) may be formed of any number of materials with FDA approval for medical use or for direct food contact.

Similarly, the foam restoration member (190) is made of a contactable material that ensures the lens is maintained free of potentially toxic or irritating leachables. Further it may be desirable that the foam restoration member 190 absorb and retain the contact lens solution, expand quickly when the package is opened, and be made of a very soft material such that the risk of damage to the surface of contact lens is minimized.

By way of example and not limitation, the foam restoration member may be selected from a group comprising homopolymers or copolymers of acrylic acid, polyvinyl alcohol, polyurethanes, polypropylene, polyvinylformal or regenerated cellulose. These soft materials also permit a disinfectant to be effectively fixed thereto. Further since these soft materials have a sufficiently high degree of the absorption of water and retention of water, the foam restoration member helps maintain the hydration of the contact lens. Also, it is desirable that the foam is a soft and pliable support that does not damage surface of the soft contact lens. In selecting a material for a foam restoration member (190) a preference is given to FDA approved materials, including polyvinyl alcohol (PVA) or polypropylene.

In one embodiment, the foam restoration member (190) is made from polyvinyl alcohol. Polyvinyl alcohol foam can be manufactured as a synthetic sponge with a three dimensional open cell structure similar to that of natural sea sponges such that each cell is interconnected with other surrounding cells. Major advantages of this three dimension open cell structure include high filtering efficiency and impressive retention and wicking properties. A PVA sponge absorbs up to 12 times its dry weight of water or water-based solution. The wet volume is about 20% greater than the dry volume. When saturated with water or water based solution, the foam becomes even more flexible and soft. PVA foam also exhibits mechanical strength and abrasion resistance equal to or greater than other synthetic sponge material. The foam pore size and shape can vary to meet specific applications. Further, than material withstands the action of dilute acids and solutions of common detergents. Untreated, the PVA foam does not contribute to the growth of bacteria nor molds. Foam that is packaged wet may be chemically treated to inhibit bacterial or mold growth.

The PVA foam shape restoration members may be constructed from in any number of manufacturing processes. By way of example and not limitation, the PVA foam shape restoration member may be manufactured by a particle replacement process or a whipped air process. In the particle replacement process for manufacturing PVA foam, starch granules can be interspersed in the PVA structure and then subsequently processed out, leaving very consistent, evenly sized pores. Whipped air technology also can be used to form the PVA pores. In this process, air alone is used to form the pores, resulting in a somewhat less even pore size. However, it is possible in this process to produce much larger pore size than the particle replacement technique. Further, whipped air manufacturing doesn't require any particles to be processed out.

The advantages of PVA foam include ultrafine pore sizes which minimize adhesion, continuous open pore structure which results in superior softness, smaller compressed size is allow for higher volumes of foam restoration members to be used, extremely fast wicking properties which absorb lens solution quickly. PVA foam is biocompatible, nontoxic, and FDA approved for surgery and medical uses.

Alternatively, closed cell foam may be used as a shape restoration member. Specifically, closed cell foam will provide a high restoration force once compressed. The gasses contained within the cells of a closed cell foam will not escape when compressed, thereby increasing the internal pressure of the closed cell foam. When a package containing the closed cell foam is opened, the internal pressure will force a shape restoration on the foam shape restoration member.

Figure 16:
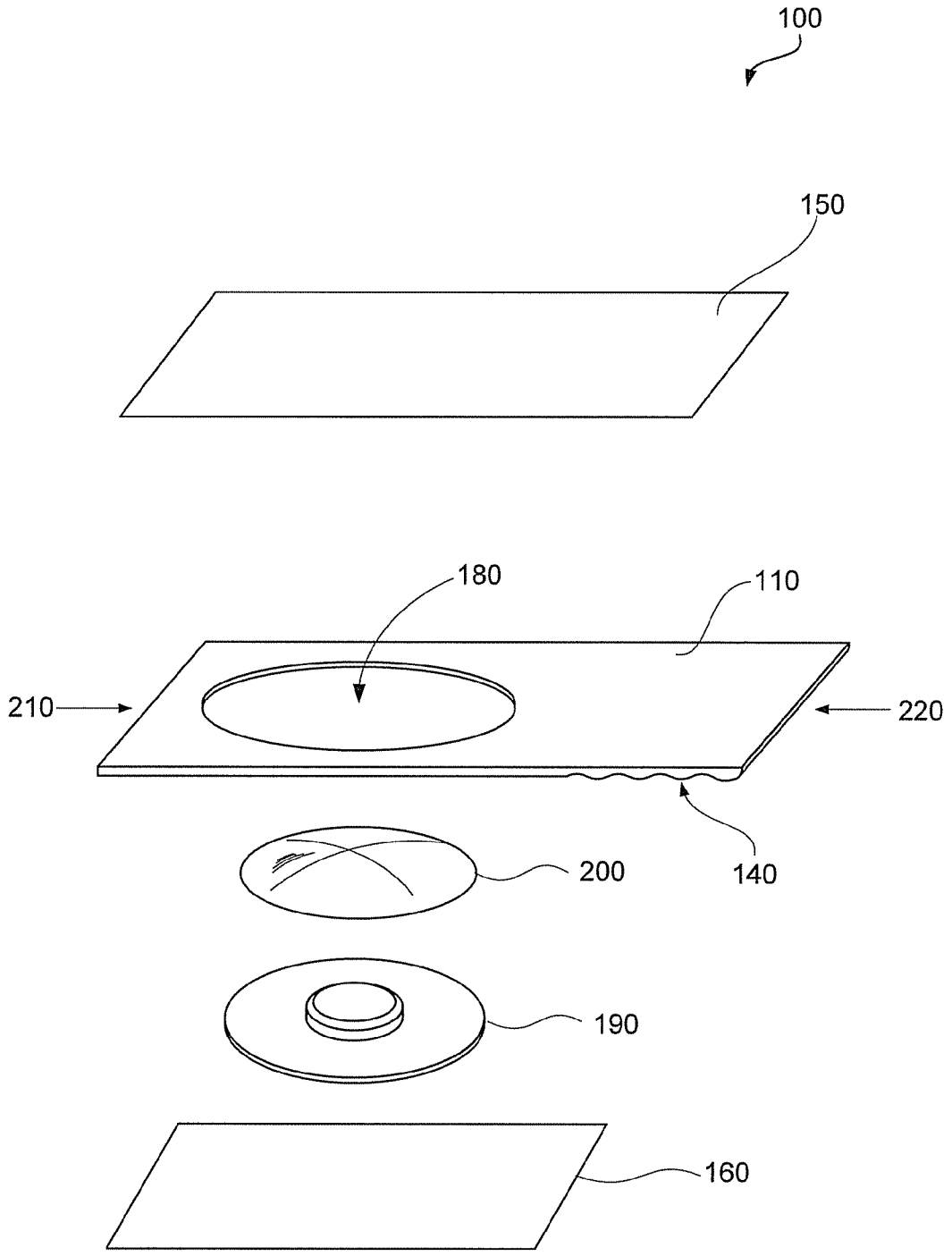
FIG. 16 is an exploded view of a contact lens package, according to one exemplary embodiment.

In FIG. 16, an exploded view of an exemplary embodiment of a contact lens package is shown. The top film layer (150) is bonded to the upper surface of the substrate layer (110). By way of example and not limitation, the top sheet member (150) may be attached to the substrate (110) by a removable heat seal which is commonly called an easy peel seal. The top sheet member may be attached to as large an area of the top surface of the substrate (110) as desired to form a seal that will not break or compromise the sterility of the contact lens (200). FIG. 9 illustrates a seal mark (170, FIG. 9) on the substrate (110) wider than used in edge seals in traditional packaging. This ensures a strong seal to maintain sterility. The adhesive also includes a peak (175, FIG. 11) toward the handle end (220, FIG. 15) of the packaging, which helps the consumer to start a break in the seal and pull back the top sheet member (150, FIG. 15).

The substrate layer (110) contains a cavity (180), configured to receive contact lens (200) and any other additional packaging materials. The substrate also has a package end (210) and a gripping end (220). The gripping end (220) can be designed with any number of features that increase the friction between the user's fingers and the substrate body to ensure a secure grip by the user during the process of opening the package. A contact lens (200) is then inserted into the cavity formed by the orifice (180) and the top sheet (150). Beneath the contact lens (200) is the foam restoration member (190). The lens, foam restoration member, and lens solution are sealed into the package by bottom film member (160). The process of assembling an exemplary contact lens package (100) is described in more detail in FIG. 33 and accompanying text.

Figure 17:
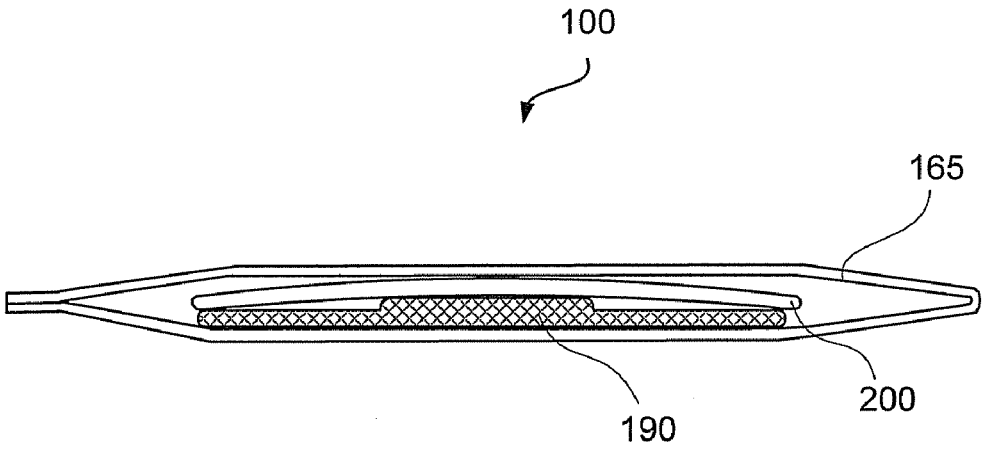
FIG. 17 is a cross-sectional side view of a contact lens package, according to one exemplary embodiment.
Figure 18:
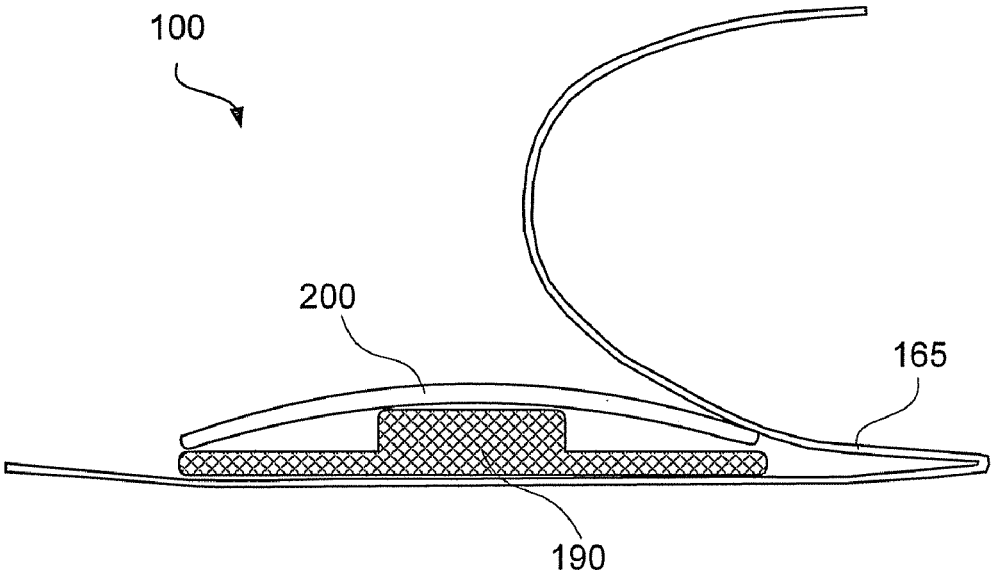
FIG. 18 is a cross-sectional side view of a partially open contact lens package, according to one exemplary embodiment.

FIGS. 17 and 18 show an alternative embodiment of a contact lens package (100). FIG. 17 shows an exemplary package configuration formed from a film (165) that is folded at one end and sealed on the other three sides to form a pouch within which the contact lens (200) and foam restoration member (190) are contained. The balance of the volume within the pouch may be filled the saline or other hydrating solution. Although FIGS. 17 and 18 show a package that is formed from a single sheet of foil, the foil package may be formed in a wide variety of configurations. By way of example and not limitation, the foil package may be formed from two individual sheets that are sealed together.

FIG. 18 shows a cross-sectional view of a partially open foil pouch (100). In this exemplary embodiment, the foil pouch (100) has been opened to expose the contact lens (200) and shape restoration member (190). The shape restoration member (190) has expanded, absorbing a portion of the surrounding saline fluid, thereby preventing it from being spilled out of the packaging. The expansion of the foam restoration member (190) facilitates the contact lens (200) returning to its relaxed state.

Figure 19:
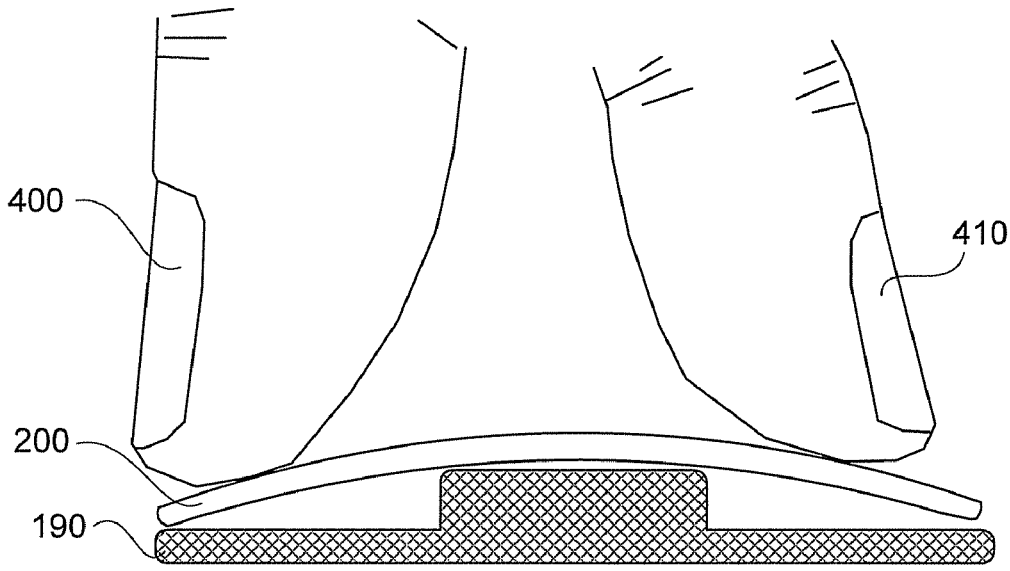
FIG. 19 is a cross-sectional side view of a user grasping a contact lens supported by a foam restoration member, according to one exemplary embodiment.
Figure 20:
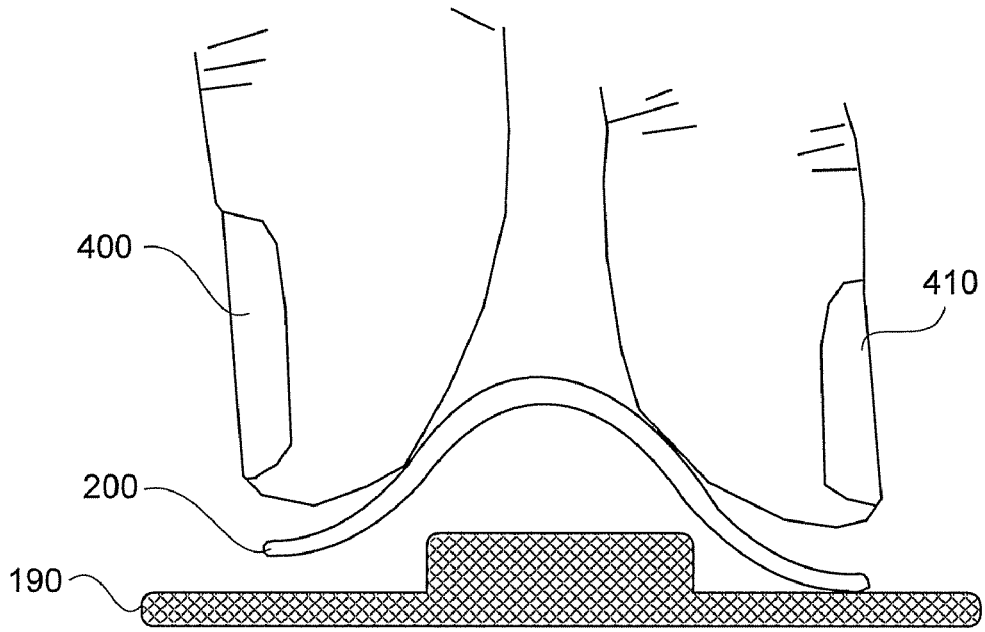
FIG. 20 is a cross-sectional side view of a user grasping a contact lens supported by a foam restoration member, according to one exemplary embodiment.

FIGS. 19 and 20 illustrate a user grasping the contact lens to lift it from the packaging prior to placing it in the user's eye. Users may grasp the contact lens in a variety of ways to prior to placing it in their eye. In one exemplary method, the desired lens package is selected by the user. The package is then opened, presenting a sterile and properly hydrated soft contact lens to the user. The foam shape restoration member (190) expands, simultaneously absorbing free contact lens solution and facilitating the contact lens (200) in returning to its relaxed shape. Further the foam restoration member lifts the lens with respect to the surrounding packaging, enabling the user better grasp and manipulate the lens during the process of removing the lens from the packaging. The packaging (110, 150, 160, FIG. 16) and foam restoration member (190) ensure that the contact lens is presented in a consistent manner, typically with the outer surface upward. The outer surface of the contact lens does not directly contact the eye of the user and is the preferred surface for contact by the user's fingers.

Prior to grasping the contact lens, best practice dictates that the contact lens user washes the fingers that will touch the lens to prevent contamination of the lens surface. Typically, the contact lens user will grasp the contact lens between a thumb and a forefinger of one hand as shown in FIGS. 19 and 20. Other methods of grasping the contact lens include, but are not limited to, placing a moistened forefinger in contact with the upper surface of the contact lens, which then preferentially adheres to the forefinger. The foam restoration member (190) facilitates this method of lifting the contact lens from the packaging by minimizing the surface tension and suction forces that would ordinarily prevent the lifting of the contact lens (200) from the package (100). The foam restoration member also minimizes surface tension by reducing the surface contact area (by virtue of its porous nature) between the underside of the contact lens and the foam, and by absorbing excess solution that might form a bond between the foam and the contact lens. The foam restoration member reduces the suction forces by providing air channels that allow the motion of air underneath the contact lens as it is lifted. The air channels may be provided by the geometry of the foam restoration member and/or through the open cell structure of the foam.

When the contact lens is grasped between the thumb (400) and the forefinger (410) as shown in FIG. 19, the foam restoration member (190) provides a compliant support for the contact lens (200) as the fingers contact it. The soft and pliable surface of the foam restoration member prevents the marring of the undersurface of the contact lens. Further, the foam pores contain the solution which has lubricant and protective qualities.

After the user's thumb (400) and forefinger (410) make contact with the lens (200), the thumb and forefinger are brought together as shown in FIG. 20. This pinches the lens between the thumb and forefinger, securing it so that it may be lifted from the packaging. The shape of the foam restoration member facilitates this motion by providing elevated support to the center lens and while being lower at the perimeter. This facilitates the folding of the lens in the center and motion of the lens edges downward and inward.

The foam restoration member (190) as shown in FIGS. 19 and 20 is about the same diameter as the contact lens. There is no requirement that the foam restoration member be the same size as the contact lens. Contact lenses vary in size according a variety of factors, including but not limited to: manufacturing considerations, optical or mechanical characteristics of the user's eye, and the prescription of the lens. Thus, the diameter of the foam restoration member (190) may be greater, smaller or equal to the diameter of a specific contact lens it is packaged with.

Figure 21:
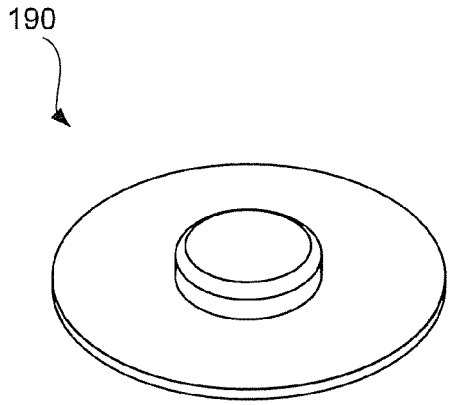
FIG. 21 is a perspective view of a button foam restoration member, according to one exemplary embodiment.
Figure 22:
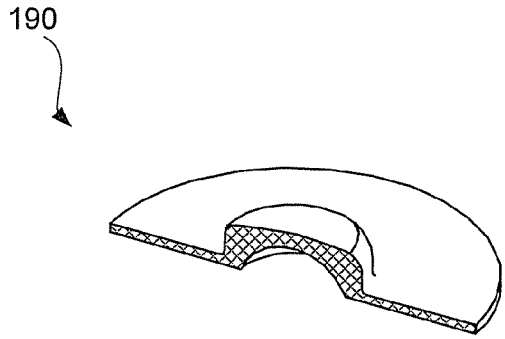
FIG. 22 is a cut-away view of a hollow button foam restoration member, according to one exemplary embodiment.
Figure 23:
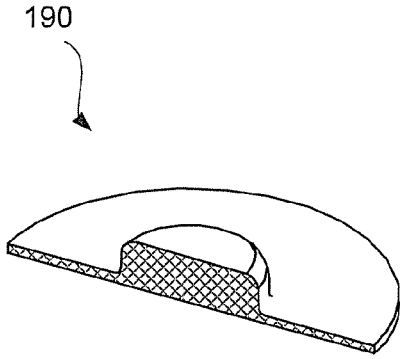
FIG. 23 is a cut-away view of a solid button foam restoration member, according to one exemplary embodiment.
Figure 24:
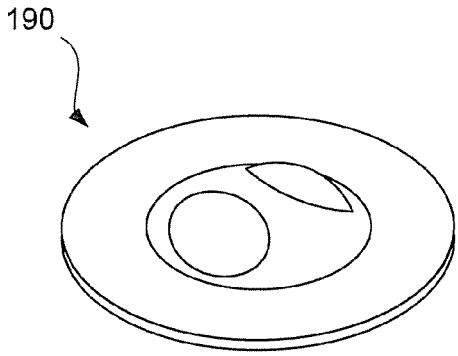
FIG. 24 is a top perspective view of a bi-nippled foam restoration member, according to one exemplary embodiment.
Figure 25:
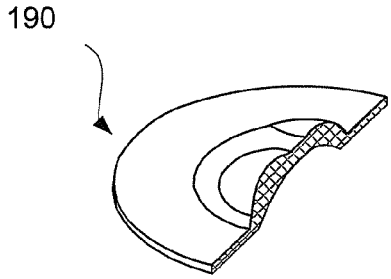
FIG. 25 is a cut-away view of a bi-nippled foam restoration member, according to one exemplary embodiment.
Figure 26:
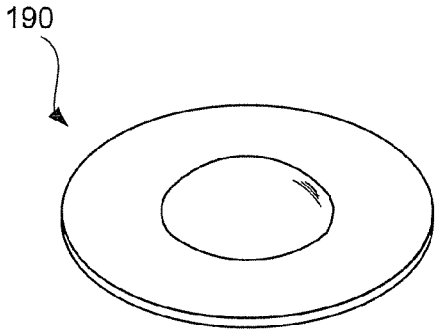
FIG. 26 is a top perspective view of a convex nippled foam restoration member, according to one exemplary embodiment.
Figure 27:
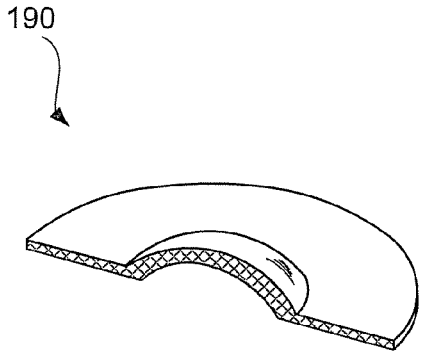
FIG. 27 is a cut away view of a hollow nipple foam restoration member, according to one exemplary embodiment.
Figure 28:
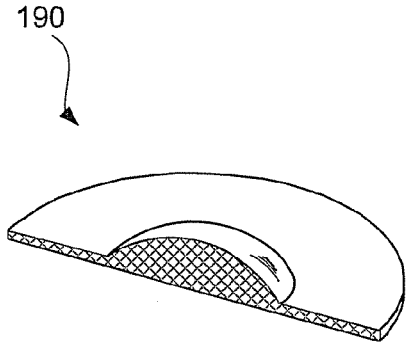
FIG. 28 is a cut-away view of a convex nippled foam restoration member, according to one exemplary embodiment.
Figure 29:
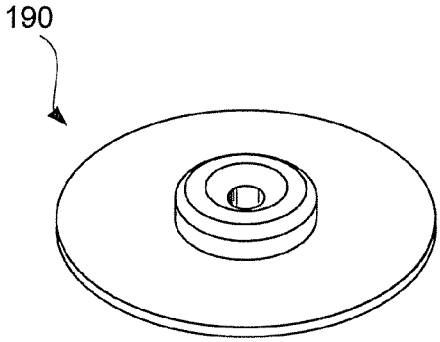
FIG. 29 is a top perspective view of a button shaped foam restoration member with a center cavity, according to one exemplary embodiment.
Figure 30:
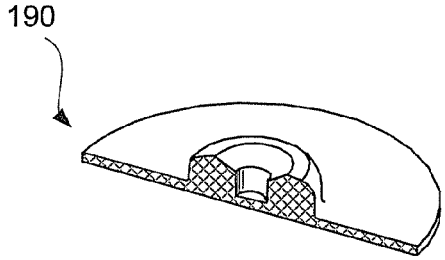
FIG. 30 is a cut away view of a button shaped foam restoration member with a center cavity, according to one exemplary embodiment.
Figure 31:
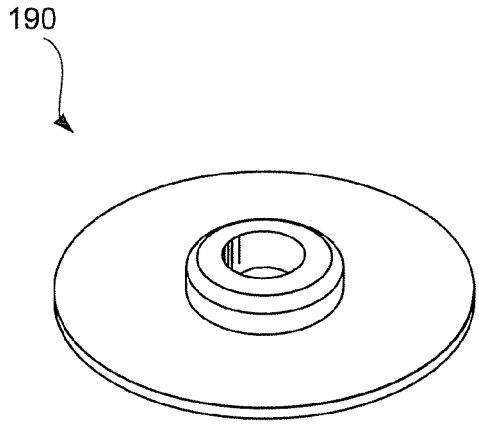
FIG. 31 is a top perspective view of a button shaped foam restoration member with a center cavity, according to one exemplary embodiment.
Figure 32:
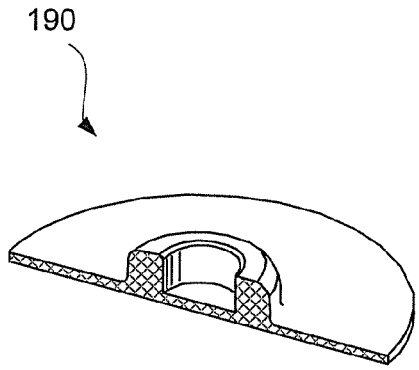
FIG. 32 is a cut away view of a button shaped foam restoration member with a center cavity, according to one exemplary embodiment.
Figure 33:
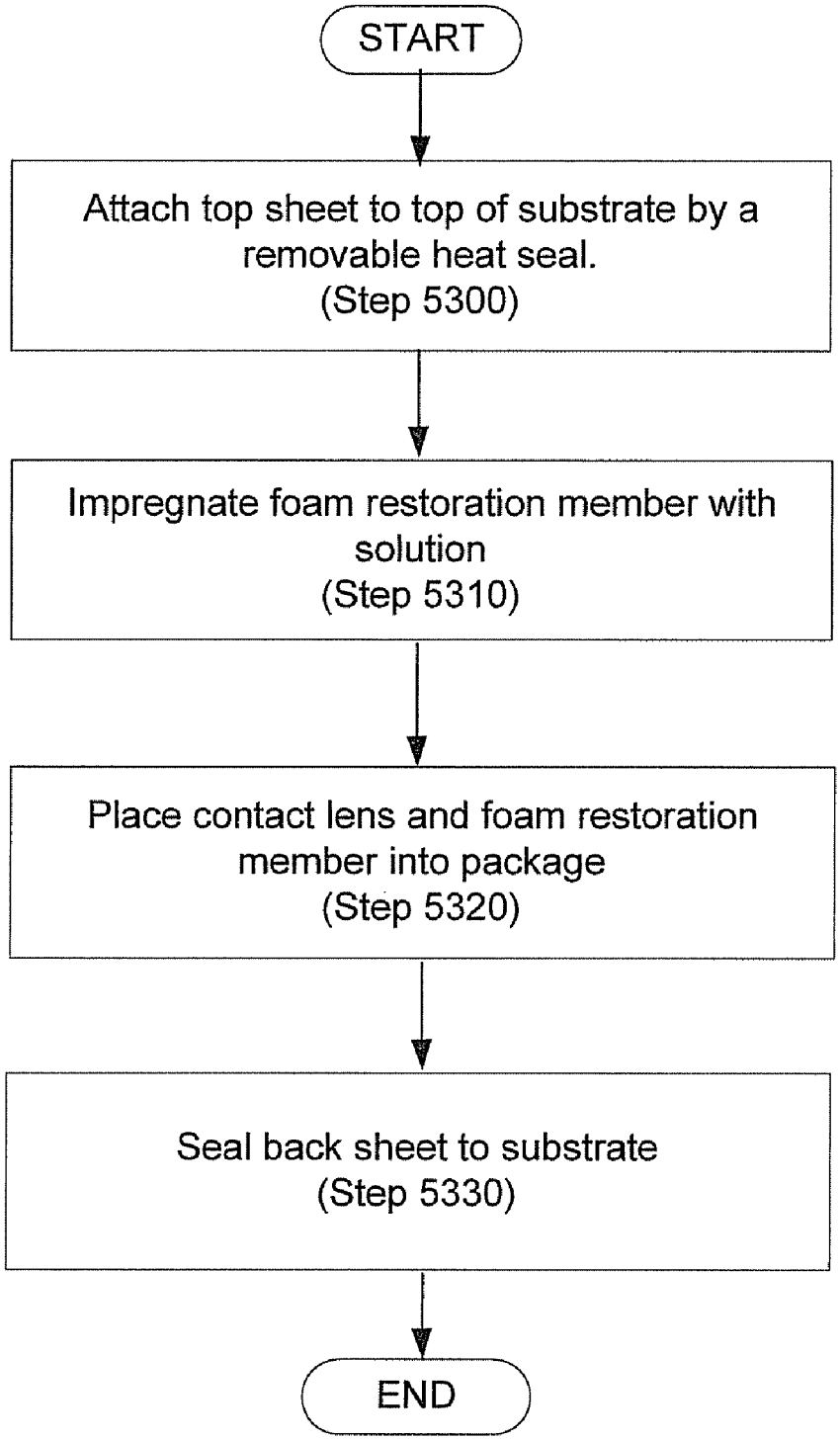
FIG. 33 is a flow chart illustrating a method for assembling contact lens packaging, according to one exemplary embodiment.

Turning now to the exemplary shapes and features of the foam restoration member as shown in FIGS. 21-32. As mentioned previously, the foam restoration member (190) may assume any number of shapes and structures. According to one exemplary embodiment, the restoration member (190) is a foam or sponge structure allows the shape restoration member (190) to be compressed with the contact lens (200) and then expand when the contact lens package (100) is opened. The use of a sponge or foam is also useful for holding fluid and aiding in the placement of the lens (200) during manufacturing. As discussed above, it may comprise any contactable compressible material, such as polyvinyl alcohol or polypropylene foam. As detailed in the figures, each of the sponge or foam structures includes a specifically shaped protrusion configured to aid in the shape restoration and correct presentation of the contact lens (200, FIG. 14) when the contact lens package (100) is opened. Ideally, the contact lens would be presented with the outer surface up, so that the outer surface of contact lens may be grasped by the finger tips without the contamination of the inner surface that will contact the user's eye. As shown in FIGS. 21, 22, and 33, the foam restoration member (190) may assume a button shape. The underside of the button may be hollow, as shown in FIG. 22 or solid as shown in FIG. 23 according to one exemplary embodiment. FIG. 24 illustrates a bi-nippled foam restoration member, according to one exemplary embodiment. FIG. 25 shows a cross-sectional diagram of the bi-nippled foam restoration member of FIG. 24. In the embodiment in FIG. 25, the bi-nippled foam restoration member has a hollow core, but similar to the embodiment shown in FIG. 22, the core could be solid as well. FIGS. 26, 27, and 28 illustrate a convex nippled foam restoration member, according to one exemplary embodiment. FIG. 26 shows a perspective view of the nippled foam restoration member. FIGS. 27 and 28 show alternative embodiments of the nippled foam restoration member shown in FIG. 26, with the embodiment of FIG. 27 having a hollow underside and the embodiment of FIG. 28 having a solid cross-section. FIGS. 29-32 illustrate a shape restoration member configured as a button with a cavity in the center. The center cavity could have the benefit of reducing the contact area of the lens with the foam making the lens easier to lift. The center cavity also facilitates the motion of air under the bottom side of the contact lens which minimizes the low pressure, or suction force beneath the contact lens as it is lifted.

Foam restoration members that have hollow undersides or hollow cross-sections may have the advantage of using less of the bulk material that makes up the foam substrate. Further, the reduced cross-section geometries have less solid thickness, allowing them to be compressed into thinner contact lens packages. Solid foam restoration members can have the advantage of exerting greater restoring force on the contact lens and absorbing additional contact lens solution. In addition to the exemplary embodiments shown in FIGS. 21-32, the shape and cross-section of the foam restoration members may be determined by various factors, including but not limited to, manufacturing issues, material cost, convenience, packaging considerations, sterility of the packaging, and marketing issues.

Additionally, the foam could contain markings or colorants that convey information to the user or assist the user in visually locating the contact lens. Information that could be conveyed by markings could include a marking that designates a specific orientation of an asymmetric contact lens, such as a lens that is designed to correct astigmatism. Other information that could be conveyed by the markings or colorants could include a symbol or color that designates which eye, the right or the left, into which the contact lens is to be inserted. The foam restoration member could also change color to convey information about the condition of the packaging or contact lens that it supports. By way of example and not limitation, the foam restoration member could change color if there is inadequate contact lens solution in the package to keep the contact lens properly hydrated. Typically, this would indicate a breach in the packaging that allowed at least some of the contact lens solution to escape and may have also allowed the entry of contaminates such as dust or bacteria. The user would be notified of the breach in the packaging and could dispose of the contact lens before inserting it into their eye. Alternatively, the user could take additional precautions before inserting the lens into their eye, such as washing or hydrating the lens. In an alternative embodiment, the foam could change color or other characteristics in directly in response to the presence of microorganisms or other contaminates.

The color or other characteristics of the foam could be also be chosen to assist the user in identifying the location of the contact lens. This could be particularly helpful for users because, as they are manipulating the packaging to insert the contact lens, they have less than perfect visual acuity. The color or other characteristics could be chosen such that the foam restoration member was visually distinct from the interior of the contact lens packaging upon which it rests and/or visually distinct from the contact lens itself. By way of example and not limitation, the center of the foam restoration member could be pigmented while the rest of the foam restoration member and the surrounding packaging were not. The center of the foam restoration member could be easily viewed by the user through the transparent contact lens. It would then be a straight forward matter to identify the location of contact lens within the packaging. Reliable visual identification of the contact lens enables the user to grasp the lens with more certainty, reducing fumbling in which the contact lens could be damaged, contaminated, or lost.

Another potential benefit of the foam restoration member could include binding antibacterial agents directly into the foam, such that the antibacterial agents do not migrate into the solution or onto the contact lens. Thus configured, the large surface area created by the open cell foam would act as an anti-bacterial agent, by destroying any micro-organisms that come into contact with the foam. This could reduce the need for anti-microbial and anti-bacterial agents in the contact lens solution. The anti-microbial and anti-bacterial agents in the contact lens solution have a greater potential to be transferred into the eye with the contact lens, potentially causing irritation or allergic reaction.

The foam restoration member also provides additional protection to the lens after the lens is packaged. During shipping, handling, and particularly as the package is transported by the user, the contact lens package can be compromised. One primary mechanism for compromising the lens package occurs when the package is brought into contact with a sharp object. The sharp object penetrates the protective foil layers allowing the lens solution to escape, contaminates to enter, and potentially directly damaging the lens itself. The foam provides a compliant support to the lens that allows the lens and protecting film to yield to the intruding object while providing some resistance to the penetrating force. If a penetrating force pierces the film from a side of the package where the foam restoration member is between the film and the lens, the object must penetrate the foam before it can directly damage the lens itself. Additionally, if the lens package is compromised, the foam member retains a portion of the lens solution, reducing the amount of fluid which might escape into the surroundings, such as the user's purse, pocket, or luggage.

FIG. 33 is a flowchart which describes an exemplary manufacturing process for assembling the components shown in FIG. 16 into a contact lens package (100). The flowchart (FIG. 33) shows only one embodiment of manufacturing processes for assembling contact lens package (100). It will be appreciated by those of skill in the art that the principles described herein could be applied to the assembly of alternative embodiments of contact lens package (100) and could be adapted to specific circumstances.

After all of the individual components have been manufactured, the top sheet (150, FIG. 16) is then attached by a removable heat seal to top of the substrate (step 5300). According to one exemplary embodiment, the easy peel seal is formed by placing the lens contacting layer of the top foil (150, FIG. 16) comprising polypropylene next to a layer of contactable material (130, FIG. 15)) comprising polypropylene on the top surface of the substrate (110, FIG. 16) and applying heat to the foil at the locations where attachment is desired, such as the region of the sealing mark (170, FIG. 14). This can be accomplished with a press having a heating region. Various other methods can also be used including, but in no way limited to, laser welding. This step is taken before the lens is in the package, and is free from constraints imposed by the presence of the lens and fluid in the package. Additionally, coupling of the top sheet (150, FIG. 16) to the substrate is typically a time consuming and delicate operation since the seal should be adequate to withstand autoclaving, while still providing a smooth and easy opening. According to one exemplary embodiment, the coupling of the top sheet member (150, FIG. 16) to the substrate (110, FIG. 16) may be performed off-site and be stockpiled, thereby reducing assembly time. In order to maintain sterility, removable seals used in traditional packaging have a width of about 2 millimeters and very strong adhesive bond. This makes the seal difficult to break when the user desires to open a traditional contact lens package. The exemplary method can seal the top sheet member (150, FIG. 16) to as large a portion of the substrate (110, FIG. 16) as desired to achieve a more distributed adhesion which has a stronger total seal but using a weaker local adhesion that allows the top sheet member (150, FIG. 16) to be peeled back more uniformly. Additionally, a peak (175, FIG. 11) in the seal makes the sheet easier to detach when the package (100, FIG. 11) is opened. This stage of the manufacturing can be done in advance of the loading of the lens; the substrate and attached top foil can be stored as work in progress until the manufacturer is ready to complete the process.

Once the top sheet member (150, FIG. 16) is coupled to the substrate, the lens and foam restoration member may be disposed in the center orifice (step 5310). According to one exemplary assembly method, the substrate (110, FIG. 14) is inverted with the top sheet member (150, FIG. 16) oriented down. A lens (200, FIG. 16) is then attached to a suction cup manufacturing arm. The arm deposits the lens (200, FIG. 16) in the center orifice (180, FIG. 16) of the substrate. Fluid may be deposited in the package by impregnating the foam restoration member with solution, depositing the fluid directly into the cavity (180, FIG. 16) before the lens is inserted, or may be deposited with the lens.

Once the lens (200, FIG. 16) and the foam restoration member (190, FIG. 16) are inserted into the center orifice (180, FIG. 16), the bottom sheet member (160, FIG. 16) may be securely sealed to the back side of the substrate (110, FIG. 16). According to one exemplary embodiment, the back sheet member (160, FIG. 16) is permanently attached to the substrate (110, FIG. 16) by a press or other manufacturing device. Because the back sheet member does not need to be removed, the back sheet member can be attached by a full seal, a more rapid process. Because the back sheet member does not need to be removed, any appropriate adhesion process can be used to attach it, including high temperature polypropylene attachment. In the process of attaching the top sheet member (150, FIG. 16), the lens (200, FIG. 16) and foam restoration member may be compressed as shown in FIG. 13, depending on the thickness of the substrate (110, FIG. 13).

According to one alternative exemplary embodiment, the bottom foil is attached the foam restoration member by surface tension or otherwise. The lens (200, FIG. 16) is held on the top surface of the foam restoration member (190) by surface tension created by the fluid carried in the foam. The bottom sheet member (160, FIG. 16) can then be attached to the substrate (110, FIG. 16), depositing and compressing the lens (200) and foam restoration member (190), depending on the size of the substrate. Alternatively, a disc may be used in place of the sponge.

Because the packaging is not filled with a large quantity of saline as is common in traditional packaging, saline fluid does not squirt out of the packaging when it is opened, as commonly happens when traditional packaging is opened. Also, because the lens is confined to one location and orientation and can be easily located by the consumer in many embodiments, the lens can be easily removed from the packaging by placing a finger, or fingers, on only outside surface of the lens, leaving the other side (which will rest on the eye) sterile. Thus the common occurrence in traditional packaging in which both sides of the lens are touched in an effort to find the lens in the saline fluid in the boat, or the lens is pushed up against the boat and may touch the un-sterile upper rim of the boat. It is also easier to orient the lens on the finger for insertion on to the eye than in traditional packaging, where the lens may be floating in various orientations in the boat.

In conclusion, the present contact lens packaging is superior to traditional packaging in many ways. It is much less bulky and can easily be stacked together. This allows for less expensive shipping and is more convenient for consumers to store and carry. The packaging keeps the contact lens in a fixed orientation and position so that the customer can easily remove the lens without searching for it or touching the eye contact surface of the lens with a finger or other un-sterile surface. The manufacturing process is superior to traditional processes because it creates a wider seal to the foil that has less risk of contamination and peels back more uniformly.

Internal members within the contact lens packaging can produce a variety of desirable results for the contact lens user. For example, the internal member can facilitate the return of the contact lens to its relaxed state after it has been packaged in a compressed state. The internal member may hold the contact lens in a consistent location and orientation, allowing the user to grasp the lens easily by the desired surface. The internal member may also be visually distinctive, allowing the user to more easily locate the contact lens within the packaging. When the internal member is constructed from a foam material, the foam member can facilitate assembly of the package by holding the desired amount of lens solution internally. The foam member can also provide additional support and protection for the lens during shipping and handling. When the package is opened the foam member can absorb a portion of the lens solution, preventing it from spilling onto the surroundings.

The preceding description has been presented only to illustrate and describe exemplary embodiments of the system and process. It is not intended to be exhaustive or to limit the system and process to any precise form disclosed. Many modifications and variations are possible in light of the above teaching. It is intended that the scope of the system and process be defined by the following claims.

What is claimed is:

1. A contact lens package, comprising:

a container member, said container member defining a cavity;

a flexible top sheet member coupled to a top surface of said container member to seal said cavity;

an unused soft contact lens disposed in said cavity, said contact lens having a convex front surface and a concave back surface; and an internal member disposed in said cavity such that said front surface of said contact lens is oriented toward and adjacent to said top sheet and said back surface of said contact lens is adjacent to said internal member;

wherein said internal member includes one of a sponge member and a foam member, said internal member being sized to be compressed in said cavity when said top sheet member is sealed to said container member and is configured to expand and engage said rear surface of said contact lens to translate at least a portion of said contact lens above said top surface of said container member when said top sheet member is at least partially removed from said top surface of said container member.

2. The contact lens package of claim 1, wherein said contact lens is sealed in said container such that said contact lens is compressed and said contact lens package has a height less than the sagittal height of said contact lens in a relaxed state.

3. The contact lens package of claim 2, wherein said internal member further comprises a protrusion configured to engage a back surface of said compressed contact lens and expand to return said contact lens to said sagittal height of said contact lens in a relaxed state when said contact lens package is opened.

4. The package of claim 1, wherein said internal member comprises a foam member.

5. The package of claim 1, wherein said internal member comprises a centerline height and an edge height, wherein said centerline height is greater than said edge height.

6. The package of claim 4, further comprising a solution disposed in said cavity; wherein said foam member is configured to absorb a portion of said solution when said package is opened to expose said contact lens.

7. The package of claim 1, wherein said internal member engages said back surface of said contact lens sufficient to hold said contact lens in a consistent orientation and location within said package.

8. The package of claim 7, wherein said internal member is visually distinct from said container.

9. The package of claim 1, wherein said internal member comprises anti-microbial or anti-bacterial properties.

10. The package of claim 1, wherein said internal member is configured to reduce a contact area between said contact lens and said package.

11. The package of claim 4 wherein said foam member is comprised of one of a polyvinyl alcohol, a polyurethane, a silicone and a polypropylene.

12. The package of claim 1 wherein said internal member is coupled to said container member.

13. The package of claim 1 wherein said internal member is free floating within said cavity.

14. A contact lens package, comprising:

a base member, said base member defining a cavity;

a flexible top sheet member coupled to a top surface of said base member to seal said cavity;

an unused soft contact lens disposed in said cavity, said contact lens having a convex front surface and a concave back surface; and an internal member disposed in said cavity such that said front surface of said contact lens is oriented toward and adjacent to said flexible top sheet and said back surface of said contact lens is adjacent to said internal member within said package;

wherein said internal member includes one of a sponge member and a foam member, said internal member being sized to be compressed in said cavity when said top sheet member is sealed to said container and is configured to expand and translate said contact lens upwardly when package is opened.

* * * * *